US009034247B2

(12) United States Patent
Suzuki et al.

(10) Patent No.: US 9,034,247 B2
(45) Date of Patent: May 19, 2015

(54) ALUMINA-FORMING COBALT-NICKEL BASE ALLOY AND METHOD OF MAKING AN ARTICLE THEREFROM

(75) Inventors: Akane Suzuki, Clifton Park, NY (US); Andrew John Elliott, Westminster, SC (US); Michael Francis Xavier Gigliotti, Jr., Glenville, NY (US); Kathleen Blanche Morey, Scotia, NY (US); Jon Conrad Schaeffer, Simpsonville, SC (US); Pazhayannur Subramanian, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 308 days.

(21) Appl. No.: 13/156,614

(22) Filed: Jun. 9, 2011

(65) Prior Publication Data

US 2012/0312426 A1 Dec. 13, 2012

(51) Int. Cl.

| | |
|---|---|
| ***C22C 19/07*** | (2006.01) |
| ***C22C 30/00*** | (2006.01) |
| ***C22F 1/10*** | (2006.01) |
| ***C22F 1/16*** | (2006.01) |
| ***C22C 19/05*** | (2006.01) |
| ***C23C 8/10*** | (2006.01) |

(52) U.S. Cl.

CPC ..... *C22C 19/07* (2013.01); *C22C 19/056* (2013.01); *C22C 19/057* (2013.01); *C22F 1/10* (2013.01); *C23C 8/10* (2013.01)

(58) Field of Classification Search

CPC .... C22C 19/056; C22C 19/057; C22C 19/07; C23C 8/10; C22F 1/10

USPC ..... 420/437–439, 580, 588; 148/284, 313, 148/674, 707

See application file for complete search history.

(56) References Cited

U.S. PATENT DOCUMENTS

| | | | |
|---|---|---|---|
| 4,078,922 | A | 3/1978 | Magyer |
| 4,152,181 | A | 5/1979 | Hirrakis |
| 5,439,640 | A | 8/1995 | Heck et al. |
| 2005/0227106 | A1 | 10/2005 | Schlichting et al. |
| 2007/0054147 | A1 | 3/2007 | Imano et al. |
| 2008/0185075 | A1 | 8/2008 | Ishida et al. |
| 2008/0185078 | A1 | 8/2008 | Ishida et al. |
| 2008/0206090 | A1 | 8/2008 | Ishida et al. |
| 2010/0061883 | A1 | 3/2010 | Nazmy et al. |
| 2010/0291406 | A1 | 11/2010 | Suzuki et al. |
| 2011/0268989 | A1 | 11/2011 | Suzuki et al. |

FOREIGN PATENT DOCUMENTS

| | | | |
|---|---|---|---|
| EP | 1410872 | A1 | 4/2004 |
| EP | 1584871 | A2 | 10/2005 |
| EP | 2251446 | A1 | 11/2010 |
| EP | 2383356 | A1 | 11/2011 |
| JP | 62228444 | A | 10/1987 |
| JP | 2141523 | A | 5/1990 |
| JP | 2009228024 | A * | 10/2009 |

OTHER PUBLICATIONS

Osaki et al., English machine translation of JP 2009-228024, Oct. 2009, p. 1-16.*

C. Cui, D. Ping, Y. Gu, H. Harada, A New Co-Base Superalloy Strengthened by y' Phase, Materials Transactions, (2006) pp. 2099 to 2102, vol. 47, No. 8, High Temperature Materials Center, National Institute for Materials Science, Tsukuba 305-0047, Japan.

J. Sato, T. Omari, K. Oikawa, I. Ohnuma, R. Kainuma, K. Ishida, "Cobalt-Base High-Temperature Alloys", Science, vol. 312, (2006) pp. 90-91.

EP Search Report EP Application Serial No. 12171280.6 dated Sep. 26, 2012.

* cited by examiner

*Primary Examiner* — Roy King
*Assistant Examiner* — Caitlin Kiechle
(74) *Attorney, Agent, or Firm* — Cantor Colburn LLP

(57) ABSTRACT

A cobalt-nickel base alloy is disclosed. The alloy includes, in weight percent: greater than about 4 % of Al, about 10 to about 20 % of W, about 10 to about 40 % Ni, about 5 to 20 % Cr and the balance Co and incidental impurities. The alloy has a microstructure that is substantially free of a CoAl phase having a B2 crystal structure and configured to form a continuous, adherent aluminum oxide layer on an alloy surface upon exposure to a high-temperature oxidizing environment. A method of making an article of the alloy includes: selecting the alloy; forming an article from the alloy; solution-treating the alloy; and aging the alloy to form an alloy microstructure that is substantially free of a CoAl phase having a B2 crystal structure, wherein the alloy is configured to form a continuous, adherent aluminum oxide layer on an alloy surface upon exposure to a high-temperature oxidizing environment.

20 Claims, 7 Drawing Sheets

| (wt%) | Co | Ni | Cr | Al | W | Ta | C | B | Hf | Si | La |
|---|---|---|---|---|---|---|---|---|---|---|---|
| Co-01 | 35.9 | 30 | 9.5 | 4.4 | 13.2 | 6.9 | 0.05 | 0.005 | | | 0.05 |
| N-Co1 | bal. | - | - | 3.4 | 26 | 5.1 | 0.2 | 0.05 | 0.1 | 0.1 | |
| N-Co2 | bal. | - | - | 8 | 27.25 | 5.2 | 0.2 | 0.05 | 0.1 | 0.1 | |
| I-Co31 | bal. | - | 3.7 | 3.6 | 23.9 | 5.2 | | | | | |
| I-Co32 | bal. | 16.6 | - | 3.8 | 26 | 5.1 | | | | | |

FIG. 7

ALUMINA-FORMING COBALT-NICKEL BASE ALLOY AND METHOD OF MAKING AN ARTICLE THEREFROM

BACKGROUND OF THE INVENTION

A high-temperature, high-strength Co—Ni base alloy and a method of making an article therefrom are disclosed. More particularly, a gamma prime (γ') strengthened Co—Ni base alloy that is capable of forming an alumina surface layer or scale is disclosed together with a process for producing the same. These alloys are suitable for making articles for applications where high temperature strength and oxidation resistance are required.

In a number of high-temperature, high-strength applications, particularly for use in industrial gas turbines, as well as engine members for aircraft, chemical plant materials, engine members for automobile such as turbocharger rotors, high temperature furnace materials and the like, high strength is needed under a high temperature operating environment, as well as excellent oxidation resistance. In some of these applications, Ni-base superalloys and Co-base alloys have been used. These include Ni-base superalloys which are strengthened by the formation of a γ' phase having an ordered face-centered cubic $L1_2$ structure: $Ni_3(Al,Ti)$, for example. It is preferable that the γ' phase is used to strengthen these materials because it has an inverse temperature dependence in which the strength increases together with the operating temperature.

In high-temperature, high-strength applications where corrosion resistance and ductility are required, Co-base alloys are commonly used alloys rather than the Ni-base alloys. The Co-base alloys are strengthened with $M_{23}C_6$ or MC type carbides, including $Co_3Ti$, $Co_3Ta$, etc. These have been reported to have the same $L1_2$-type structure as the crystal structure of the γ' phase of the Ni-base alloys. However, $Co_3Ti$ and $Co_3Ta$ have a low stability at high temperature. Thus, even with optimization of the alloy constituents these alloys have an upper limit of the operating temperature of only about 750° C., which is generally lower than the γ' strengthened Ni-base alloys.

A Co-base alloy that has an intermetallic compound of the $L1_2$ type [$Co_3(Al,W)$] dispersed and precipitated therein, where part of the Co may be replaced with Ni, Ir, Fe, Cr, Re, or Ru, while part of the Al and W may be replaced with Ni, Ti, Nb, Zr, V, Ta or Hf, has been disclosed in US2008/0185078. Under typical oxidation conditions, the Co-base alloys strengthened with $Co_3(Al,W)$ typically form cobalt-rich oxides, such as CoO, $Co_3O_4$ and $CoWO_4$, which are not protective and result in poor oxidation and corrosion resistance. While good high-temperature strength and microstructure stability have been reported for this alloy, further improvement of the high-temperature properties are desirable, particularly improved high-temperature oxidation and corrosion resistance.

BRIEF DESCRIPTION OF THE INVENTION

According to one aspect of the invention, a cobalt-nickel base alloy is disclosed. The cobalt-nickel base alloy, comprises, in weight percent: greater than about 4% of Al, about 10 to about 20% of W, about 10 to about 40% Ni, about 5 to 20% Cr and the balance Co and incidental impurities. The alloy has a microstructure that is substantially free of a CoAl phase having an ordered body-centered cubic B2 crystal structure and configured to form a continuous, adherent aluminum oxide layer on an alloy surface upon exposure to a high-temperature oxidizing environment.

According to another aspect of the invention, a method of making an article having high-temperature strength, oxidation resistance and corrosion resistance is disclosed. The method comprises: forming a cobalt-nickel base alloy, comprising, in weight percent: greater than about 4% of Al, about 10 to about 20% of W, about 10 to about 40% Ni, about 5 to 20% Cr and the balance Co and incidental impurities; forming an article from the cobalt-nickel base alloy; solution-treating the cobalt-nickel base alloy by a solution heat treatment at a solutionizing temperature that is above the gamma prime solvus temperature and below the solidus temperature for a predetermined solution-treatment time; and aging the cobalt-nickel base alloy by providing at least one aging heat treatment at an aging temperature that is less than the gamma-prime solvus temperature for a predetermined aging time to form an alloy microstructure that comprises a plurality of gamma prime precipitates comprising $(Co,Ni)_3(Al,W)$ and is substantially free of a CoAl phase having a B2 crystal structure, wherein the alloy is configured to form a continuous, adherent aluminum oxide layer on an alloy surface upon exposure to a high-temperature oxidizing environment.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

FIG. 7 is a table illustrating the compositions of an exemplary alloy as disclosed and several comparative related art alloys;

The detailed description explains embodiments of the invention, together with advantages and features, by way of example with reference to the drawings.

DETAILED DESCRIPTION OF THE INVENTION

Figure 1:
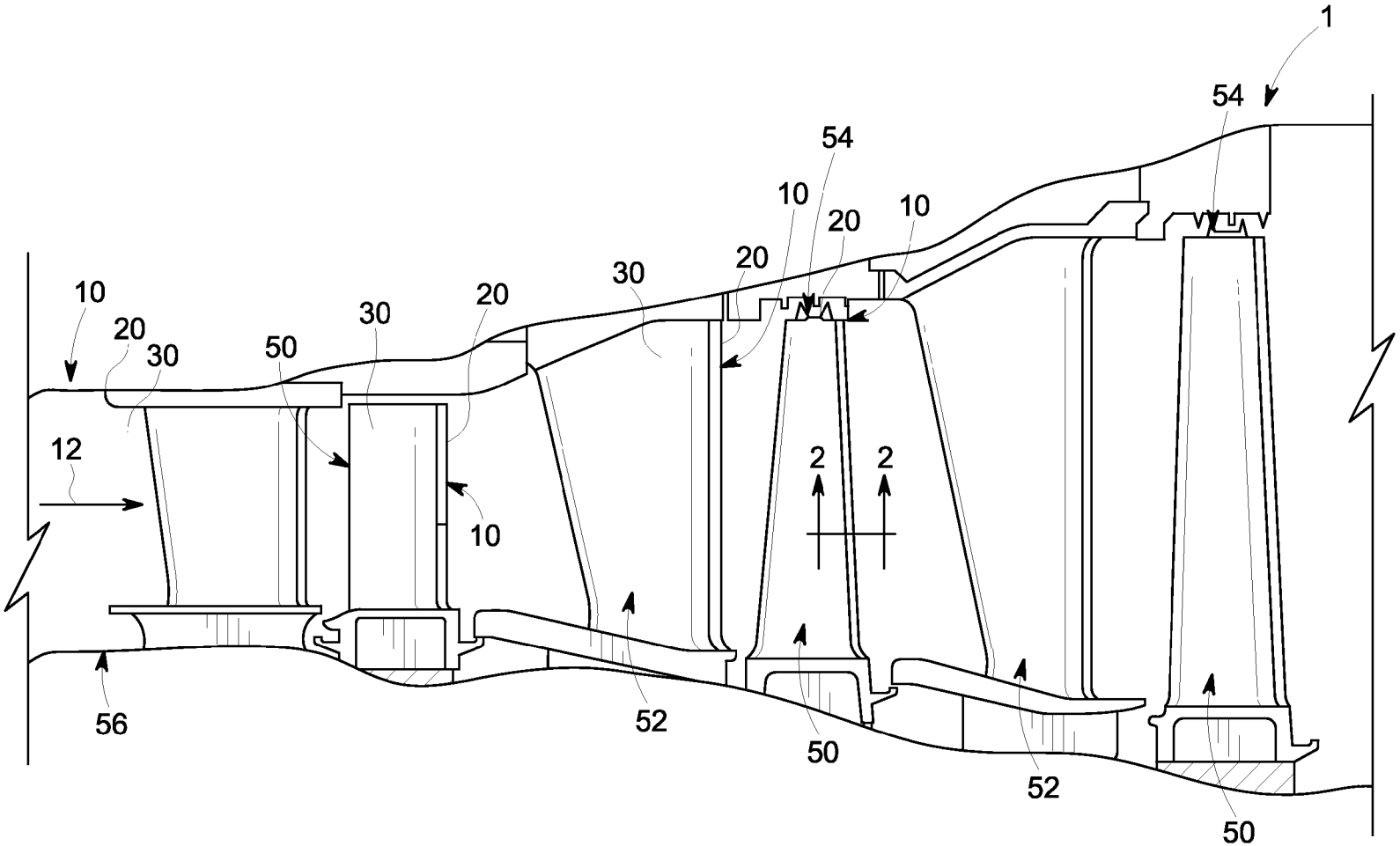
FIG. 1 is a schematic cross-sectional view of an exemplary embodiment of certain high-temperature articles and a turbine engine as disclosed herein.
Figure 2:
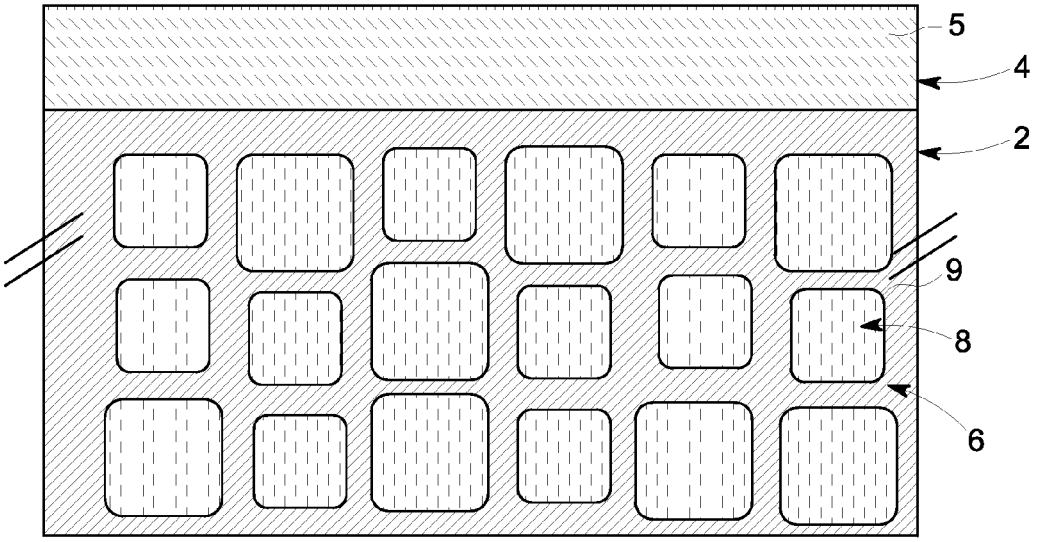
FIG. 2 is a schematic cross-sectional view of an exemplary embodiment of an article of FIG. 1 taken along section 2-2 and an exemplary embodiment of a Co—Ni alloy as disclosed herein.

Referring to FIGS. 1 and 2, Co—Ni-base alloys 2 having a desirable combination of high temperature strength, ductility, oxidation resistance and corrosion resistance are disclosed. These Co—Ni-base alloys 2 constitute superalloys and have a melting temperature that is higher than typical Ni-base superalloys by about 50° C. and comparable to that of many Co-base alloys. The diffusion coefficient of substitutional elements in the lattice of the Co—Ni-base alloys is generally smaller than that of Ni-base alloys. Therefore, the Co—Ni-base alloys 2 possess good microstructural stability and mechanical properties at high temperatures. Further, deformation processing of the Co—Ni-base alloy 2 can be performed by forging, rolling, pressing, extrusion, and the like. These alloys have greater high-temperature oxidation resistance than conventional Co-based alloys due to the enhanced stability of their microstructures. The surfaces of these alloys are enhanced by the ability to form stable protective oxide layers, which are particularly suited for the hot gas paths of turbine engines, such as industrial gas turbine engines. This enhanced stability is due, in part, to the formation of a continuous, adherent aluminum oxide layer 4 (e.g., alumina) on the surface of articles 10 formed from these alloys 2. When various high-temperature articles 10 made of these alloys, such as, for example, various turbine engine components, including blades, vanes, shrouds, liners, transition pieces, and other components used in the hot gas flowpath of an industrial gas turbine engine, the articles form an alumina layer on the surface in the high-temperature oxidizing environment that exists during operation of the engine. Many Co-base alloys use formation of chromia to achieve good oxidation resistance. However, chromia scale is not protective above 980° C. due to the decomposition of chromia into $CrO_3$. Alumina is a more stable and has slower growth rate than chromia. Therefore, alumina-former alloys are preferred over chromia-former alloys, and can be used at higher temperatures. This enhanced stability during operation also extends to engine components with various protective coatings, including various bond coats, thermal barrier coatings, and combinations thereof. Many gas turbine components are coated, but the oxidation resistance of the coated materials is affected by the oxidation resistance of the underlying substrate material. Typically, substrate materials with good oxidation resistance provide better oxidation resistance of the coated materials and better coating compatibility.

The Co—Ni-base alloys 2 disclosed herein generally comprise, in weight percent, greater than about 4% of Al, about 10 to about 20% of W, about 10 to about 40% Ni, about 5 to 20% Cr and the balance Co and incidental impurities. The alloy composition range was selected to provide preferential outward diffusion of Al to form a surface alumina layer. The amount of alloying elements will generally be selected to provide sufficient Ni to form a predetermined volume quantity of $[(Co,Ni)_3(Al,W)]$ precipitates, which contribute to the desirable high-temperature alloy characteristics described above. More particularly, the alloy may include about 15% to about 35% by weight of Ni, and even more particularly may include about 20% to about 35% by weight of Ni. The Al amount will generally be selected to provide a tightly adherent surface aluminum oxide layer 4 that includes aluminum oxide, and more particularly that includes alumina 5 ($Al_2O_3$). This may include greater than about 4% by weight of Al, and more particularly may include greater than about 4% to about 6% by weight of Al. The Cr amount will generally be selected to promote formation of a continuous, adherent alumina layer on the surface of the substrate alloy. This may include about 5% to about 20% by weight of Cr, and more particularly may include greater than about 7% to about 15% by weight of Cr. These Co—Ni-base alloys 2 also may include other alloying additions as described further herein. The Co—Ni-base alloys disclosed herein generally comprise an alloy microstructure that includes a solid-solution gamma (γ) phase matrix 6, where the solid-solution comprises (Co, Ni) with various other substitutional alloying additions as described herein. The alloy microstructure also includes a gamma prime (γ') phase 8 that includes a plurality of dispersed precipitate particles 9 that precipitate in the gamma matrix 6 during processing of the alloy as described herein. The γ' precipitates act as a strengthening phase and provide the Co—Ni-base alloys with their desirable high-temperature characteristics. Alloying additions other than those described above may be used to modify the gamma phase, such as to promote the formation and growth of the aluminum oxide layer 4 on the surface, or to promote the formation and affect the characteristics of the γ' precipitates as described herein.

The γ' phase 8 precipitates 9 comprise an intermetallic compound comprising $[(Co,Ni)_3(Al,W)]$ and have an $L1_2$ crystal structure. The lattice mismatch between the γ matrix 6 and the γ' phase 8 precipitates 9 dispersed therein that is used as a strengthening phase in the disclosed Co—Ni-base alloys 2 may be up to about 0.5%. This is significantly less than the mismatch of the lattice constant between the γ matrix 6 and the γ' phase precipitates comprising $Co_3Ti$ and/or $Co_3Ta$ in Co-base alloys, where the lattice mismatch may be 1% or more, and which have a lower creep resistance than the alloys disclosed herein. Further, by controlling the aluminum content of the Co—Ni-base alloys disclosed herein, as well as the contents of other alloy constituents such as Ti and Cr, the alloys provide an adherent, continuous aluminum oxide layer 4 on the alloy surface that continues to increase in thickness and provide enhanced protection during their high-temperature use.

The size and volume quantity of the γ' phase 8 $[(Co,Ni)_3(Al,W)]$ precipitates 9 may be controlled to provide a predetermined particle size, such as a predetermined average particle size, and/or a predetermined volume quantity, by appropriate selection and processing of the alloys, including selection of the constituent amounts of the elements comprising the precipitates, as well as appropriate time and temperature control during solution heat treatment and aging heat treatment, as described herein. In one exemplary embodiment, the γ' phase 8 $[(Co,Ni)_3(Al,W)]$ precipitates 9 may be precipitated under conditions where the average precipitate particle diameter is about 1 μm or less, and more particularly about 500 nm or less. In another exemplary embodiment, the precipitates may be precipitated under conditions where their volume fraction is about 5 to 90%, and more particularly about 25 to about 85%. For larger particle diameters, the mechanical properties such as strength and hardness may be reduced. For smaller precipitate amounts, the strengthening is insufficient and for larger amount, the ductility may be reduced.

In the Co—Ni-base alloys 2 of the present invention, the alloy constituents have been described generally as comprising, in weight percent, greater than about 4% of Al, about 10 to about 20% of W, about 10 to about 40% Ni, about 5 to 20% Cr and the balance Co and incidental impurities. The amounts of Ni and Al will generally be selected to provide sufficient amounts of these constituents to form a predetermined volume quantity and/or predetermined particle size of $[(Co,Ni)_3(Al,W)]$ precipitates, which contribute to the desirable high-temperature alloy characteristics described above. In addition, other alloy constituents may be selected to promote the high-temperature properties of the alloy, particularly the formation and high-temperature stability over time of the $[(Co,Ni)_3(Al,W)]$ precipitates 9, the formation and growth of the adherent, continuous aluminum oxide layer 4 on the surface and ensuring that the alloy 2 is substantially free of the CoAl beta phase.

Ni is a major constituent of the γ and γ' phases. The amount of Ni is selected to limit the effect on the γ phase, such as, for example, reduction in the melting point from that characteristic of Co (1495° C.) for Co-base alloys to that of Ni (1453° C.) for Ni-base alloys. The amount of Ni is also selected to promote formation of $[(Co,Ni)_3(Al,W)]$ precipitates having the desirable $L1_2$ crystal structure that provide the reduced lattice mismatch as compared to Co-base alloys. In an exemplary embodiment, the alloy may include greater than about 10% to about 40% of Ni, and more particularly may include about 15% to about 35% by weight of Ni, and even more particularly may include about 20% to about 35% by weight of Ni.

Al is also a major constituent of the γ' phase 8 and also contributes to the improvement in oxidation resistance by formation of an adherent, continuous aluminum oxide layer 4 on the surface, which in an exemplary embodiment comprises alumina 5 ($Al_2O_3$). The amount of aluminum included in the alloy must be sufficiently large to form the adherent, continuous aluminum oxide layer 4 on the surface, and may also be selected to provide sufficient aluminum to enable continued growth of the thickness of the aluminum oxide layer 4 on the surface during high-temperature operation of articles formed from the alloy. The amount of aluminum included in these alloys must be also be sufficiently small to ensure that the alloys are substantially free of the CoAl beta phase with a B2 crystal structure, since the presence of this phase tends to significantly reduce their high temperature strength. In an exemplary embodiment, the alloy 2 may include greater than about 4% by weight of Al, and more particularly may include greater than about 4% to about 6% by weight of Al. Lower amounts of Al will prevent the formation of the adherent, continuous aluminum oxide layer 4 on the alloy surface and higher amounts of aluminum will promote the formation of a CoAl beta phase with a B2 crystal structure.

W is also a major constituent element of the γ' phase 8 and also has an effect of solid solution strengthening of the matrix, particularly due to its larger atomic size as compared to that of Co, Ni and Al. In an exemplary embodiment, the alloy 2 may include about 10% to about 20% by weight of W. Lower amounts of W will result in formation of an insufficient volume fraction of γ' phase and higher amounts of W will result in the formation of undesirable phases, such as $\mu$-$Co_7W_6$ and $Co_3W$ phases.

In addition, the Co—Ni-base alloys 2 disclosed herein may also include a predetermined amount of Si or S, or a combination thereof. In another exemplary embodiment, Si may be added in an amount effective to enhance the oxidation resistance of the Co—Ni base alloys, and may include about 0.01% to about 1% by weight of the alloy. In yet another exemplary embodiment, S may be controlled as an incidental impurity to also enhance the oxidation resistance of the Co—Ni base alloys, and may be reduced to an amount of less than about 5 ppm by weight of the alloys, and more particularly may be reduced to an amount of less than about 1 ppm by weight of the alloys. The reduction of S as an incidental impurity to the levels described is generally effective to improve the oxidation resistance of the alloys 2 and improve alumina scale adhesion, resulting in adherent aluminum oxide scales that are resistant to spallation.

Further, the Co—Ni-base alloys 2 disclosed herein may also include a predetermined amount of Ti effective to promote the formation of the adherent, continuous aluminum oxide layer 4 on the alloy surface. In one exemplary embodiment, Ti may include up to about 10% of the alloy, and more particularly up to about 5% of the alloy.

These Co—Ni-base alloys 2 are advantageously substantially free of macro segregation of the alloy constituents, particularly Al, Ti or W, or a combination thereof, such as is known to occur in Ni-base superalloys upon solidification. More particularly, these alloys are substantially free of macro segregation of the alloy constituents, including those mentioned, in the interdendritic spaces of castings. This is a particularly desirable aspect at the surface of these alloys because macro segregation can cause pits or pimples (protrusions) to form at the alloy surface of Ni-base superalloys during high temperature oxidation. Such pits or pimples are mixed oxides or spinel, such as mixed oxides of magnesium, ferrous iron, zinc, or manganese, in any combination.

Other alloy constituents may be selected to modify the properties of the Co—Ni-base alloys 2. In an exemplary embodiment, constituents may be selected from the group consisting of B, C, Y, Sc, lanthanides, misch metal, and combinations thereof. In one exemplary embodiment the total content of constituents from this group may be selected from the range of about 0.001 to about 2.0% by weight of the alloy.

B is generally segregated in the γ phase 6 grain boundaries and contributes to the improvement in the high temperature strength of the alloys. The addition of B in amounts of about 0.001% to about 0.5% by weight is generally effective to increase the strength and ductility of the alloy, and more particularly about 0.001% to about 0.1% by weight.

C is also generally segregated in the γ phase 6 grain boundaries and contributes to the improvement in the high temperature strength of the alloys. It is generally precipitated as a metal carbide to enhance the high-temperature strength. The addition of C in amounts of about 0.001% to about 1% by weight is generally effective to increase the strength of the alloy, and more particularly about 0.001% to about 0.5% by weight.

Y, Sc, the lanthanide elements, and misch metal are generally effective in improving the high-temperature oxidation resistance of the alloys. The addition of these elements, in total, in amounts of about 0.01% to about 0.5% by weight is generally effective to improve the oxidation resistance of the alloy and improve alumina scale adhesion, and more particularly about 0.001% to about 0.2% by weight. These elements may also be included together with control of the sulfur content to improve the oxidation resistance of these alloys 2 and improve alumina scale adhesion. When reactive elements or rare earths are employed in these alloys 2, it is desirable that the materials of the ceramic systems used as casting molds which contact the alloy be selected to avoid depletion of these elements at the alloy 2 surface. Thus, the use of Si-based ceramics in contact with the alloy 2 surface is generally undesirable, as they cause depletion of rare earth elements in the alloy which can react with the Si-based ceramics to form lower melting point phases. In turn, this can result in defects leading to lower low cycle fatigue (LCF) strength and reduced creep strength. The use of ceramic systems that employ non-reactive face coats on the ceramic (e.g., $Y_2O_3$ flour) or Al-based ceramics is desirable when reactive elements or rare earth elements are employed as alloy 2 constituents.

Mo may be employed as an alloy constituent to promote stabilization of the γ' phase and provide solid solution strengthening of the γ matrix. The addition of Mo in amounts of up to about 10% by weight is generally effective to provide these benefits, and more particularly up to about 5% by weight.

Re and Ru may be employed as alloy constituents to improve the oxidation resistance of Co—Ni-base alloys. The addition of Re or Ru, or a combination of them, in a total amount of up to about 10% by weight is generally effective to provide this benefit, and more particularly a total amount of up to about 5% by weight.

Ti, Nb, Zr, V, Ta, and Hf may also be employed as alloy constituents to provide stabilization of the γ' phase 8 and improvement of the high temperature strength of Co—Ni-base alloys 2. As indicated, the amount of these elements in total may include about 0% to about 15% of the alloy. When employed, the addition of these elements in the following amounts is generally effective to provide these benefits, including: Ti of up to about 10%, and more particularly, up to about 5%; Nb of up to about 10%, and more particularly, up to about 5%; Zr of up to about 3.0%, and more particularly, about up to 1%; V of up to about 5%, and more particularly, up to about 2%; Ta of up to about 15%, and more particularly, up to about 12%; and Hf of up to about 3%, and more particularly, up to about 2%. Amounts in excess of these limits may reduce the high-temperature strength and reduce the solidus temperature of the alloy, thereby reducing its operating temperature range, and more particularly its maximum operating temperature.

As illustrated in FIG. 1, the Co—Ni-base alloys 2 disclosed herein may be used to make various high-temperature articles 10 having the high-temperature strength, ductility, oxidation resistance and corrosion resistance described herein. These articles 10 include components 20 that have surfaces 30 that comprise the hot gas flowpath 40 of a gas turbine engine, such as an industrial gas turbine engine. These components 20 include turbine buckets or blades 50, vanes 52, shrouds 54, liners 56, combustors and transition pieces (not shown) and the like.

Referring to FIGS. 1 and 2, these articles 10 having high-temperature strength, oxidation resistance and corrosion resistance may be made by a method 100, comprising: forming 110 a cobalt-nickel base alloy, comprising, in weight percent: greater than about 4% of Al, about 10 to about 20% of W, about 10 to about 40% Ni, about 5 to 20% Cr and the balance Co and incidental impurities; forming 120 an article from the cobalt-nickel base alloy 2; solution-treating 130 the cobalt-nickel base alloy 2 by a solution heat treatment at a solutionizing temperature that is above the γ' solvus temperature and below the solidus temperature for a predetermined solution-treatment time to homogenize the microstructure; and aging 140 the cobalt-nickel base alloy by providing at least one aging heat treatment at an aging temperature that is less than the gamma-prime solvus temperature for a predetermined aging time to form an alloy microstructure that comprises a plurality of gamma prime precipitates comprising $(Co,Ni)_3(Al,W)$ and is substantially free of a CoAl phase having a B2 crystal structure. Method 100 may optionally include coating 150 the alloy 2 with a protective coating.

Melting 110 of the Co—Ni-base alloy 2 may be performed by any suitable melting method, including vacuum induction melting (VIM), vacuum arc remelting (VAR) or electro-slag remelting (ESR). In the case where the molten Co—Ni-base alloy, which is adjusted to a predetermined composition, is used as a casting material, it may be produced by any suitable casting method, including various investment casting, directional solidification or single crystal solidification methods.

Forming 120 of an article 10 having a predetermined shape from the cobalt-nickel base alloy 2 may be done by any suitable forming method. In an exemplary embodiment, the cast alloy can be hot-worked, such as by forging at a solution treatment temperature and may also be cold-worked. Therefore, the Co—Ni-base alloy 2 can be formed into many intermediate shapes, including various forging billets, plates, bars, wire rods and the like. It can also be processed into many finished or near net shape articles 10 having many different predetermined shapes, including those described herein. Forming 120 may be done prior to solution-treating 130 as illustrated in FIG. 2. Alternately, forming may be performed in conjunction with either solution-treating 130 or aging 140, or both of them, or may be performed afterward.

Solution-treating 130 of the cobalt-nickel base alloy 2 may be performed by a solution heat treatment at a solutionizing temperature that is between the γ' solvus temperature and the solidus temperature for a predetermined solution-treatment time. The Co—Ni-base alloy 2 is formed into an article 10 having a predetermined shape and then heated at the solutionizing temperature. In an exemplary embodiment, the solutionizing temperature may be between about 1100 to about 1400° C., and more particularly may be between about 1150 to about 1300° C., for a duration of about 0.5 to about 12 hours. The strain introduced by forming 120 is removed and the precipitates are solutionized by being dissolved into the matrix 6 in order to homogenize the material. At temperatures below the solvus temperature, neither the removal of strain nor the solutionizing of precipitates is accomplished. When the solutionizing temperature exceeds the solidus temperature, some liquid phase is formed and coarsening growth of the crystal grains occurs, which reduces the high-temperature strength of the article 10.

Aging 140 of the cobalt-nickel base alloy 2 is performed by providing at least one aging heat treatment at an aging temperature that is lower than the γ' solvus temperature for a predetermined aging time, where the time is sufficient to form an alloy microstructure that comprises a plurality of γ' precipitates comprising $[(Co,Ni)_3(Al,W)]$ and is substantially free of a CoAl phase having a B2 crystal structure. In an exemplary embodiment, the aging treatment may be performed at a temperature of about 700 to about 1200° C., to precipitate $[(Co,Ni)_3(Al,W)]$ having an $L1_2$-type crystal structure that has a lower lattice constant mismatch between the γ' precipitate and the γ matrix. The cooling rate from the solution-treating 130 to aging 140 may also be used to control aspects of the precipitation of the γ' phase, including the precipitate size and distribution within the γ matrix. The aging heat treatment may be conducted in one, or optionally, in more than one heat treatment step, including two steps and three steps. The heat treatment temperature may be varied as a function of time within a given step. In the case of more than one step, the steps may be performed at different temperatures and for different durations, such as for example, a first step at a higher temperature and a second step at a somewhat lower temperature.

Either or both of solution treating 130 and aging 140 heat treatments may be performed in a heat treating environment that is selected to reduce the formation of the surface layer of alumina, including vacuum, inert gas and reducing atmosphere heat treating environments. This may be employed, for example, to limit the formation of the aluminum oxide layer 4 on the surface of the alloy prior to coating the surface of the alloy with a thermal barrier coating material to improve the bonding of the coating material to the alloy surface.

Figure 3:
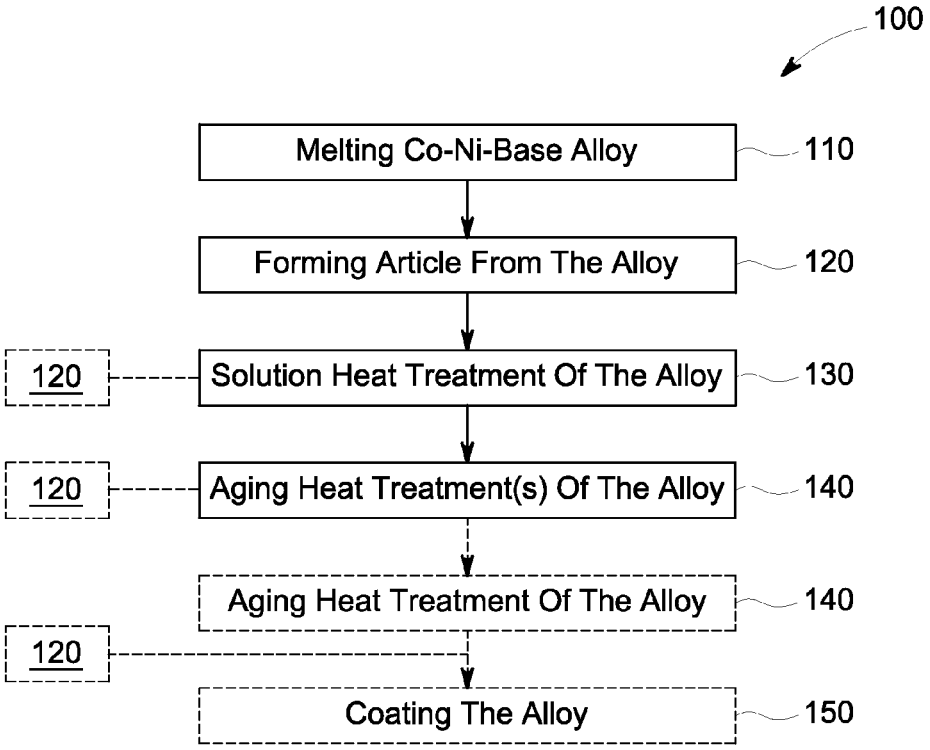
FIG. 3 is a flow chart of an exemplary embodiment of a method of making the alloy as disclosed herein.

Referring to FIGS. 1, 3 and 7, coating 150 may be performed by coating the alloy 2 with any suitable protective coating material, including various metallic bond coat materials, thermal barrier coating materials, such as ceramics comprising yttria stabilized zirconia, and combinations of these materials. When these protective coatings are employed, the oxidation resistance of the alloy 2 improves the oxidation resistance of the coated components and the coating compatibility, such as by improving the spallation resistance of thermal barrier coatings applied to the surface of the alloy 2.

In a Ni—Al binary system, γ' is a thermodynamically stable $Ni_3Al$ phase with an $L1_2$ crystal structure in an equilibrium phase diagram and is used as a strengthening phase. Thus, in Ni-base alloys using this system as a basic system, γ' has been used as a primary strengthening phase. In contrast, in an equilibrium phase diagram of the Co—Al binary system, a γ' $Co_3Al$ phase is not present and has been reported that the γ' phase is a metastable phase. The metastable γ' phase has reportedly been stabilized by the addition of W in order to use the γ' phase as a strengthening phase of various Co-base alloys. Without being bound by theory, in the Co—Ni solid solution alloys disclosed herein, the γ' phase described as a $[(Co,Ni)_3(Al,W)]$ phase with an $L1_2$ crystal structure may comprise a mixture of a thermodynamically stable $Ni_3Al$ with an $L1_2$ crystal structure and metastable $Co_3(Al,W)$ that is stabilized by the presence of W that also has an $L1_2$ crystal structure. In any case, the γ' phase comprising a $[(Co,Ni)_3(Al,W)]$ phase with an $L1_2$ crystal structure is precipitated as a thermodynamically stable phase.

In an exemplary embodiment, the γ' phase intermetallic compound $[(Co,Ni)_3(Al,W)]$ is precipitated according to method 100, and more particularly aging 140, in the γ phase matrix 6 under conditions sufficient to provide a particle diameter of about 1 m or less, and more particularly, about 10 nm to about 1 μm, and even more particularly about 50 nm to about 1 μm, and the amount of γ' phase precipitated is about 5% or more by volume, and more particularly about 25 to about 85% by volume.

EXAMPLE 1

An exemplary embodiment of an alloy having a composition, by weight, of Co-30% Ni-4.4% Al-13.2% W-9.5% Cr-6.9% Ta-0.05% C-0.005% B-0.05% La was prepared by induction melting. The alloy was solution heat treated at 1250° C. for 2 hours and then aged at 950° C. for 100 hours. Cylindrical specimens 0.9" long and 0.17" in diameter were machined from the alloy and several comparative alloys and exposed to a high-temperature oxidizing environment to test and demonstrate the oxidation characteristics of the alloy. As used herein, a high-temperature oxidizing environment, such as exists in the hot gas flow path of an industrial gas turbine engine during its operation, may be defined as an environment wherein alloy 2 articles 10 that are located therein may experience temperatures of 1650° F. or more in the presence of oxygen sufficient to cause their oxidation, and more particularly, may include environments that may experience temperatures of 1800° F. or more in the presence of oxygen sufficient to cause their oxidation. Cyclic oxidation tests were conducted in air with a cycle consisting of holding the samples at 1800° F. in air for 50 min and then cooling the samples in air to room temperature for 10 min Tests were completed at 1000 thermal cycles. Samples were weighed at various intervals during the test to monitor the weight change due to oxide formation or spallation. Oxides formed on the surface were analyzed by X-ray diffraction (XRD) and electron probe micro analysis (EPMA).

Figure 4:
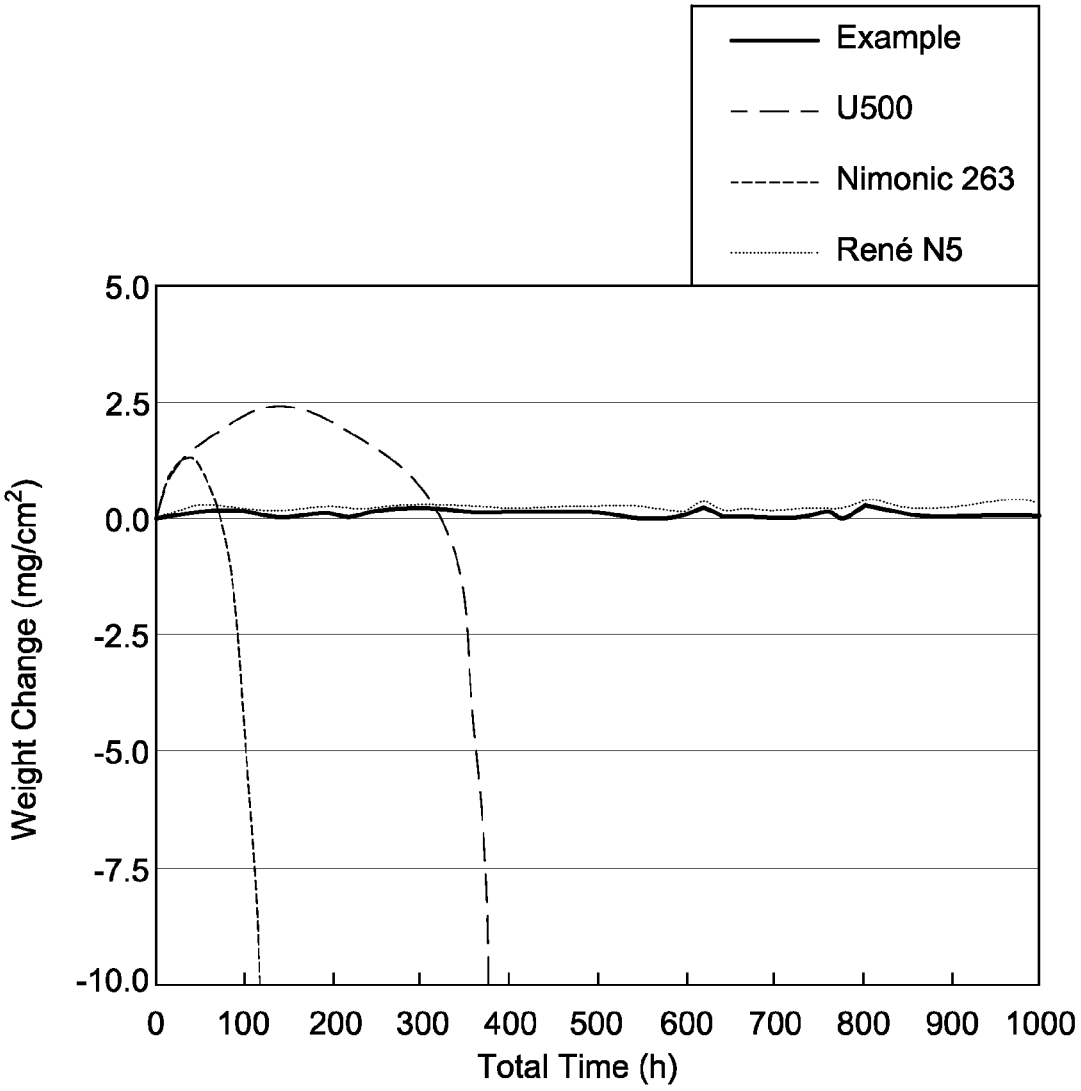
FIG. 4 is a plot of weight change as a function of time at 1800° F. in an oxidizing environment.

FIG. 4 shows the weight change as a function of time during the oxidation test at 1800° F. The exemplary alloy does not show significant weight change up to 1000 hours, and the oxidation behavior and resistance is similar to that of an alumina-forming nickel-base superalloy, René N5 having a composition, by weight, of Ni-7.5% Co-7% Cr-1.5% Mo-6% W-3% Re-6.2% Al-6.5% Ta-0.15% Hf-0.05% C-0.004% B. The minimal weight change of these alloys indicates the formation of a continuous, adherent, protective aluminum oxide layer on the surface of these alloys. On the other hand, conventional nickel-base superalloys, Nimonic 263 having a composition, by weight, of Ni-20% Co-20% Cr-5.9% Mo-0.5% Al-2.1% Ti-0.4% Mn-0.3% Si-0.06% C-0.005% B-0.02% Zr and Udimet 500 having a composition, by weight, of Ni-19% Co-18% Cr-4.2% Mo-3% Al-3% Ti-0.08% C-0.006% B-0.05% Zr, gained weight in the beginning of the test and then lost weight after 50 hours and 300 hours, respectively, which corresponded to and is indicative of spallation of oxides from the metal surfaces.

Figure 5:
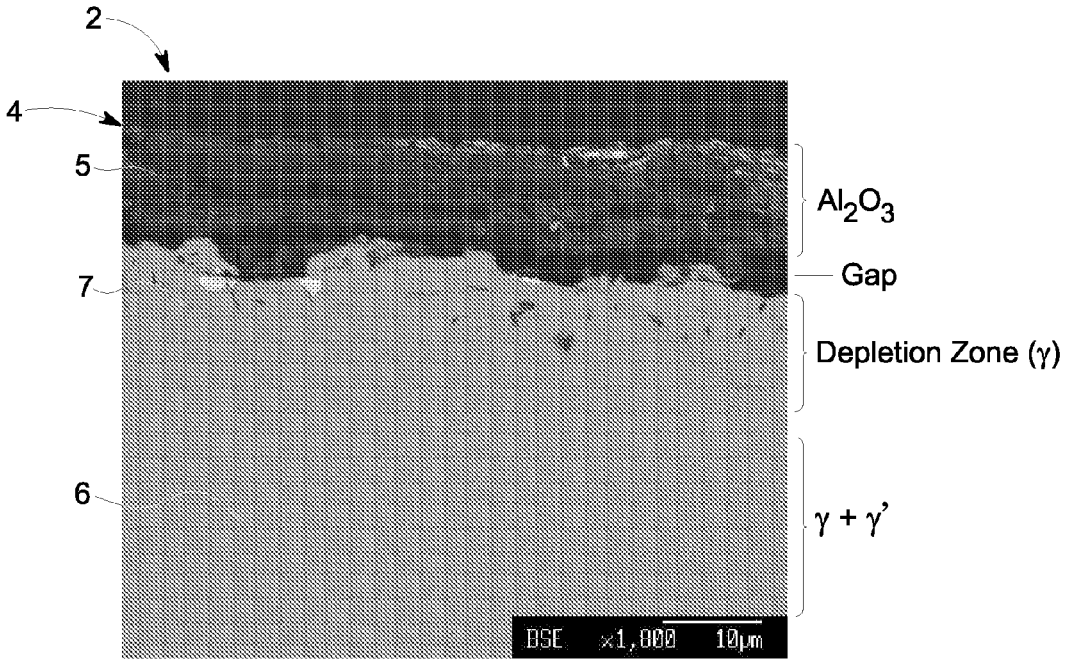
FIG. 5 is a back scatter scanning electron microscope image of an exemplary embodiment of the alloy having a continuous, adherent aluminum oxide layer on the surface after exposure to a high temperature oxidizing environment.
Figure 6:
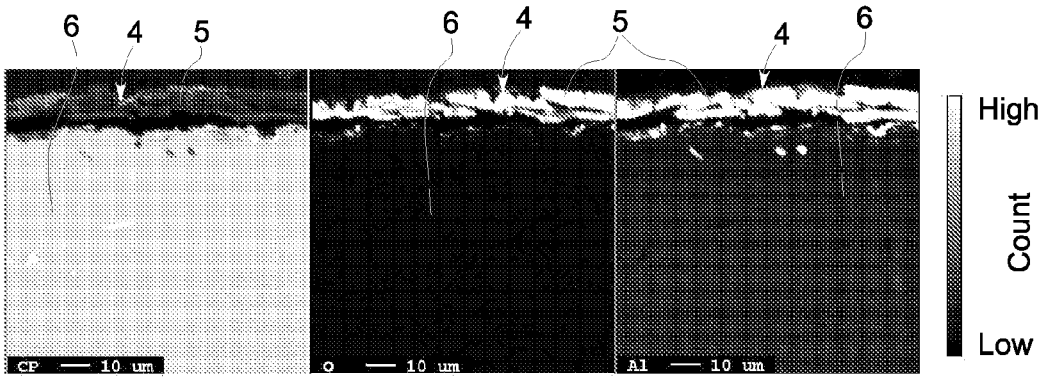
FIG. 6 is a back scatter scanning electron microscope image of a region of the surface of an exemplary embodiment of the alloy having a continuous, adherent aluminum oxide layer on the surface after exposure to a high temperature oxidizing environment together with associated images illustration the distribution of oxygen and aluminum in the region.

FIG. 5 shows a back-scattered electron image of the sample alloy after the completion of the oxidation tests. A continuous, adherent aluminum oxide layer 4 is observed on the surface of the alloy 2 substrate. A depletion zone 7 or concentration gradient may exist proximate to the aluminum oxide layer 4 where the amount or concentration of γ' phase 8 in the γ phase matrix 6 is reduced as compared to its concentration in the other portions of the γ phase matrix 6 due to the Al consumed to form the aluminum oxide layer 4. FIG. 6 shows the elemental distributions of oxygen and aluminum proximate to the surface of the alloy 2 and in the aluminum oxide layer 4 together with a back-scattered electron image. The oxide layer 4 exhibits a high concentration of aluminum, and XRD analysis showed the presence of corundum $Al_2O_3$ 5.

Figure 8:
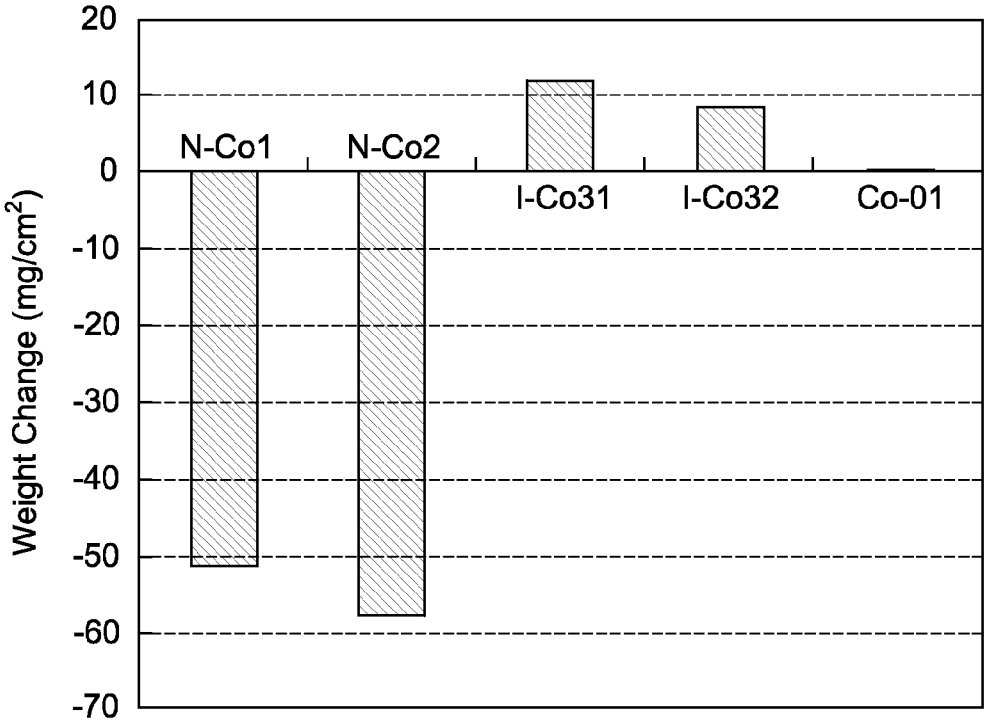
FIG. 8 is a plot of weight gain/loss of the alloys of FIG. 7 after exposure at 1800° F. for 100 hours in an oxidizing environment.
Figure 9A:
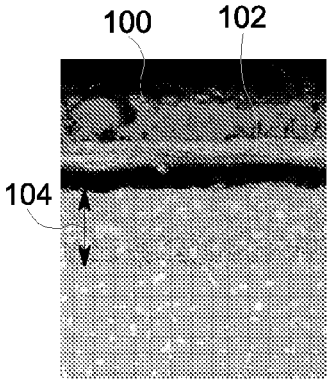
FIGS. 9A-9E are photomicrographs of sections of the alloys of FIG. 7 illustrating the microstructures of the alloys proximate their surfaces after exposure at 1800° F. for 100 hours in an oxidizing environment.
Figure 9B:
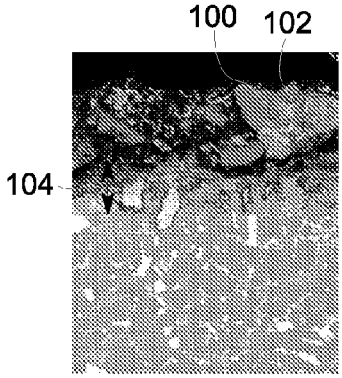
Figure 9C:
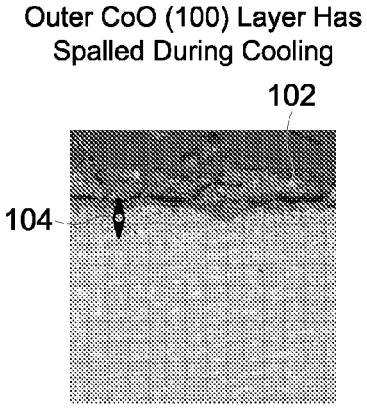
Figure 9D:
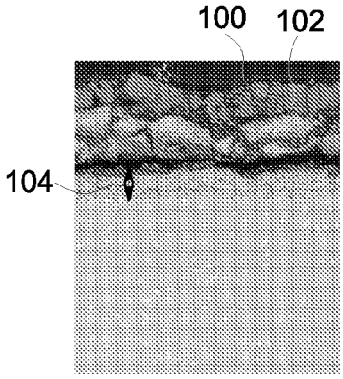
Figure 9E:
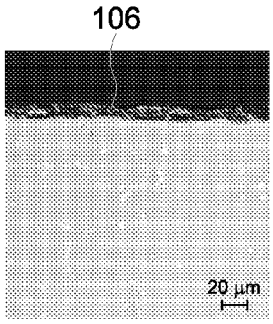

The alloy of this example was also compared to several other related art alloys as described in US2008/0185078 (alloys 31 and 32, Table 6) and US2010/0061883 (alloys Co-01 and Co-02, Table 2), which were also prepared by induction melting. The alloy compositions are shown in FIG. 7. These alloys were solution heat treated at 1250° C. for 4 hours in argon. Specimens 0.125" thick were sliced from the solutionized materials, and flat surfaces were polished using 600 grit sandpaper. The test coupons were then exposed to a high-temperature oxidizing environment as part of an isothermal oxidation test at 1800° F. (982° C.) for 100 h and the weights were measured before and after the oxidation tests. The results are shown in FIG. 8 which plots the weight change due to oxidation. The related art alloys showed either significant weight reduction due to oxide spallation or weight gain due to formation of thick oxide layers. The related art alloys showed significant surface and subsurface oxidation, including spallation of the surface oxide layer in sample I—Co31. These alloys microstructures are illustrated in the micrographs of FIGS. 9A-9D. Alloy N—Co1 forms CoO 100 and a complex oxide enriched with W and Co 102 that shows (the gap between metal and oxide layer is formed during cooling from 1800° F. due to larger thermal expansion coefficient of metal than of oxides and a substantial internal oxidation layer 104 (FIG. 9A) (about 50 microns). Alloy N—Co2 also forms a relatively thick layer of CoO 100 and a W,Co-rich oxide 102 on the surface and an internal oxidation layer 104 (FIG. 9B). The total thickness of oxides and internally oxidized layers is 60-100 microns. This alloy also formed a significant amount of undesirable beta-CoAl phase throughout the alloy microstructure. Alloy I—Co31 forms CoO 100 that spalled away and a relatively thick W,Co-rich oxide layer 102 on the surface, as well as exhibiting an internal oxidation layer 104 (FIG. 9C). Alloy I—Co32 forms a relatively thick layer of CoO 100 and W,Co-rich oxide 102 on the surface, as well as exhibiting an internal oxidation layer 104 (FIG. 9D). The properties disclosed herein, including oxidation resistance (alumina-former) and avoid formation of undesired phases (such as beta-CoAl phase) may be achieved using the compositions disclosed herein. The alloy disclosed herein showed significantly improved oxidation resistance, including substantially no weight gain and exhibited a thin (less than 10 microns thick), adherent surface oxide layer 106 comprising substantially alumina with a few spinel intermixed and substantially no spallation or internal (subsurface) oxidation as illustrated in FIG. 9E, thereby demonstrating the improvement over related art alloys.

The terms "first," "second," and the like, "primary," "secondary," and the like, as used herein do not denote any order, quantity, or importance, but rather are used to distinguish one element from another.

The terms "a" and "an" do not denote a limitation of quantity, but rather denote the presence of at least one of the referenced item.

Unless defined otherwise, technical and scientific terms used herein have the same meaning as is commonly understood by one of skill in the art to which this invention belongs.

The modifier "about" used in connection with a quantity is inclusive of the stated value and has the meaning dictated by the context (e.g., includes the degree of error associated with measurement of the particular quantity). The endpoints of all ranges directed to the same component or property are inclusive of the endpoint and independently combinable.

As used herein, "combination" is inclusive of blends, mixtures, alloys, reaction products, and the like.

Reference throughout the specification to "one embodiment", "another embodiment", "an embodiment", and so forth, means that a particular element (e.g., feature, structure, and/or characteristic) described in connection with the embodiment is included in at least one embodiment described herein, and may or may not be present in other embodiments. In addition, it is to be understood that the described elements may be combined in any suitable manner in the various embodiments.

In general, the compositions or methods may alternatively comprise, consist of, or consist essentially of, any appropriate components or steps herein disclosed. The invention may additionally, or alternatively, be formulated so as to be devoid, or substantially free, of any components, materials, ingredients, adjuvants, or species, or steps used in the prior art compositions or that are otherwise not necessary to the achievement of the function and/or objectives of the present claims.

As used herein, unless the text specifically indicates otherwise, reference to a weight or volume percent of a particular alloy constituent or combination of constituents, or phase or combination of phases, refers to its percentage by weight or volume of the overall alloy, including all of the alloy constituents.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A cobalt-nickel base alloy, comprising: greater than about 4% to about 6% by weight of Al, about 10 to about 20% by weight of W, about 10 to 32.5% by weight of Ni, about 5 to about 20% by weight of Cr, Si in an amount up to about 1% by weight, and the balance Co and incidental impurities, the alloy having a microstructure that is substantially free of a CoAl phase having a B2 crystal structure and configured to form a continuous, adherent aluminum oxide layer on an alloy surface upon exposure to a high-temperature oxidizing environment.

2. The cobalt-nickel base alloy of claim 1, wherein Si comprises about 0.01 to about 1% by weight.

3. The cobalt-nickel base alloy of claim 1, further comprising a predetermined amount of S.

4. The cobalt-nickel base alloy of claim 3, wherein the predetermined amount of S comprises less than about 5 ppm by weight of the alloy.

5. The cobalt-nickel base alloy of claim 4, wherein the predetermined amount of S comprises less than about 1 ppm by weight of the alloy.

6. The cobalt-nickel base alloy of claim 1, further comprising up to about 5% of Ti by weight of the alloy.

7. The cobalt-nickel base alloy of claim 1, wherein the alloy microstructure further comprises a solid-solution gamma phase matrix and a plurality of dispersed gamma prime precipitates.

8. The cobalt-nickel base alloy of claim 7, wherein the gamma prime phase precipitates comprise $[(Co,Ni)_3(Al,W)]$ and have an $L1_2$ crystal structure.

9. The cobalt-nickel base alloy of claim 7, wherein the alloy further comprises at least one element selected from a group consisting of Re, Ru, Mo, Ti, Nb, Zr, V, Ta, Hf, and combinations thereof.

10. The cobalt-nickel base alloy of claim 1, further comprising about 0.001 to about 2.0%, by weight of the alloy, of an element selected from the group consisting of B, C, Y, Sc, a lanthanide, misch metal, and combinations thereof.

11. The cobalt-nickel base alloy of claim 1, wherein the alloy comprises a turbine engine component.

12. The cobalt-nickel base alloy of claim 11, wherein the turbine engine component comprises a protective coating disposed on the surface of the alloy.

13. The cobalt-nickel base alloy of claim 11, wherein the turbine engine component further comprises the aluminum oxide layer on the surface of the alloy.

14. The cobalt-nickel base alloy of claim 1, wherein the alloy comprises, in weight percent, about 10% to about 31% Ni.

15. A method of making an article having high-temperature strength, oxidation resistance and corrosion resistance, comprising:

forming a cobalt-nickel base alloy, comprising, in weight percent: greater than about 4% to about 6% by weight of Al, about 10 to about 20% by weight of W, about 10 to 32.5% by weight of Ni, about 5 to 20% by weight of Cr, Si in an amount up to about 1% by weight, and the balance Co and incidental impurities, the alloy having a microstructure that is substantially free of a CoAl phase having a B2 crystal structure and configured to form a continuous, adherent aluminum oxide layer on an alloy surface upon exposure to a high-temperature oxidizing environment;

forming an article from the cobalt-nickel base alloy;

solution-treating the cobalt-nickel base alloy by a solution heat treatment at a solutionizing temperature that is above the gamma prime solvus temperature and below the solidus temperature for a predetermined solution-treatment time; and aging the cobalt-nickel base alloy by providing at least one aging heat treatment at an aging temperature that is less than the gamma-prime solvus temperature for a predetermined aging time to form an alloy microstructure that comprises a plurality of gamma prime precipitates comprising $(Co,Ni)_3(Al,W)$ and is substantially free of a CoAl phase having a B2 crystal structure, wherein the alloy is configured to form a continuous, adherent aluminum oxide layer on an alloy surface upon exposure to a high-temperature oxidizing environment.

16. The method of claim 15, wherein Si comprises about 0.01 to about 1% by weight.

17. The method of claim 15, wherein the alloy further comprises at least one element selected from a group consisting of Re, Ru, Mo, Ti, Nb, Zr, V, Ta, Hf, and combinations thereof.

18. The method of claim 15, wherein the article comprises a component of a gas turbine engine, further comprising operating the component at a operating temperature in the oxidizing environment sufficient to form the continuous, adherent aluminum oxide layer on the alloy surface.

19. The method of claim 15, wherein the article comprises a component of a gas turbine engine, the method further comprising disposing a protective coating material on the alloy surface.

20. The method of claim 19, further comprising operating the component at an operating temperature in the oxidizing environment sufficient to form the continuous, adherent aluminum oxide layer on the alloy surface.

* * * * *